US008709235B2

(12) United States Patent
Hedrick et al.

(10) Patent No.: US 8,709,235 B2
(45) Date of Patent: Apr. 29, 2014

(54) PROCESS FOR MIXING IN FLUIDIZED BEDS

(75) Inventors: Brian W. Hedrick, Oregon, IL (US); Keith A. Couch, Arlington Heights, IL (US); Robert L. Mehlberg, Wheaton, IL (US); Mohammad-Reza Mostofi-Ashtiani, Naperville, IL (US)

(73) Assignee: UOP LLC, Des Plaines, IL (US)

( * ) Notice: Subject to any disclaimer, the term of this patent is extended or adjusted under 35 U.S.C. 154(b) by 1310 days.

(21) Appl. No.: 12/509,830

(22) Filed: Jul. 27, 2009

(65) Prior Publication Data

US 2009/0283446 A1 Nov. 19, 2009

Related U.S. Application Data

(62) Division of application No. 11/614,862, filed on Dec. 21, 2006, now Pat. No. 7,585,470.

(51) Int. Cl.

| | |
|---|---|
| ***C10G 35/00*** | (2006.01) |
| ***C10G 11/16*** | (2006.01) |
| ***C10G 11/18*** | (2006.01) |

(52) U.S. Cl.

CPC ..... *C10G 11/16* (2013.01); *C10G 11/18* (2013.01)

USPC ..... 208/146; 208/176; 422/139; 422/145; 366/101; 366/137.1

(58) Field of Classification Search

CPC ..... C10G 11/16; C10G 11/18; B01J 19/10

USPC ..... 422/139, 145; 366/101, 137.1; 208/146, 208/176

See application file for complete search history.

(56) References Cited

U.S. PATENT DOCUMENTS

| | | | |
|---|---|---|---|
| 4,414,100 | A | 11/1983 | Krug et al. |
| 4,558,168 | A | 12/1985 | Gussow et al. |
| 4,578,183 | A | 3/1986 | Chou et al. |
| 4,615,992 | A | 10/1986 | Murphy |
| 5,059,305 | A | 10/1991 | Sapre |
| 5,248,408 | A | 9/1993 | Owen |
| 5,601,787 | A | 2/1997 | Owen et al. |

(Continued)

FOREIGN PATENT DOCUMENTS

| | | | |
|---|---|---|---|
| WO | 2005080531 | A1 | 9/2005 |
| WO | 2006071771 | A1 | 7/2006 |

OTHER PUBLICATIONS

Couch, "Controlling FCC Yields and Emissions UOP Technology for a Changing Environment", NPRA Annual Meeting paper, Mar. 23-25, 2003, San Antonio, Texas.

(Continued)

*Primary Examiner* — Nina Bhat

(74) *Attorney, Agent, or Firm* — James C Paschall

(57) ABSTRACT

Process for increasing mixing in a fluidized bed. A slide, which may be in the form of a tube or trough, transports particles from an upper zone downward to a lower zone at a different horizontal position, thereby changing the horizontal position of the particle and creating lateral mixing in the fluidized bed. Increased mixing may improve efficiency for an apparatus using a fluidized bed. For example, increased lateral mixing in a regenerator may increase temperature and oxygen mixing and reduce stagnation to improve efficiency. A slide may be relatively unobtrusive, inexpensive, and simple for a retrofit or design modification and may improve combustion efficiency at high rates by enhancing the lateral blending of spent and regenerated catalyst.

4 Claims, 4 Drawing Sheets

(56) References Cited

U.S. PATENT DOCUMENTS

| | | | | |
|---|---|---|---|---|
| 5,773,378 | A | 6/1998 | Bussey et al. | |
| 6,809,054 | B1 * | 10/2004 | Myers et al. | 502/41 |
| 7,153,478 | B2 | 12/2006 | Xu et al. | |
| 7,153,479 | B2 | 12/2006 | Peterson et al. | |
| 7,172,733 | B2 * | 2/2007 | Gauthier et al. | 422/145 |
| 7,311,746 | B2 | 12/2007 | Stell et al. | |
| 7,332,132 | B2 | 2/2008 | Hedrick et al. | |
| 7,396,971 | B2 | 7/2008 | Smith et al. | |
| 7,585,470 | B2 | 9/2009 | Hedrick et al. | |
| 7,588,679 | B2 * | 9/2009 | Gauthier et al. | 208/108 |
| 2004/0004025 | A1 | 1/2004 | Xu et al. | |
| 2004/0024276 | A1 | 2/2004 | Smith et al. | |
| 2005/0205467 | A1 | 9/2005 | Hedrick et al. | |
| 2005/0261530 | A1 | 11/2005 | Stell et al. | |

OTHER PUBLICATIONS

Rosser, "Integrated View to Understanding the FCC NOx Puzzle", AIChe Annual Meeting paper, 2004.

* cited by examiner

PROCESS FOR MIXING IN FLUIDIZED BEDS

CROSS-REFERENCE TO RELATED APPLICATION

This application is a Division of copending application Ser. No. 11/614,862 filed Dec. 21, 2006, the contents of which are hereby incorporated by reference in its entirety.

BACKGROUND OF THE INVENTION

This invention relates generally to apparatus and processes using fluidized beds. More specifically, this invention relates to increasing the lateral mixing of particles in fluidized beds.

DESCRIPTION OF THE PRIOR ART

Fluidized beds are used in many industrial applications. One use in particular is in the regenerator of a petroleum refining process.

Fluid catalytic cracking (FCC), as well as Resid FCC (RFCC), is a catalytic conversion process for cracking heavy hydrocarbons into lighter hydrocarbons by bringing the heavy hydrocarbons into contact with a catalyst composed of finely divided particulate material. Most FCC units use zeolite-containing catalyst having high activity and selectivity.

The basic components of the FCC reactor section include a riser, a reactor, a catalyst stripper, and a regenerator. In the riser, a feed distributor inputs the hydrocarbon feed which contacts the catalyst and is cracked into a product stream containing lighter hydrocarbons. Catalyst and hydrocarbon feed are transported upwardly in the riser by the expansion of the lift gases that result from the vaporization of the hydrocarbons, and other fluidizing mediums, upon contact with the hot catalyst. Steam or an inert gas may be used to accelerate catalyst in a first section of the riser prior to or during introduction of the feed. Coke accumulates on the catalyst particles as a result of the cracking reaction and the catalyst is then referred to as spent catalyst. The reactor disengages spent catalyst from product vapors. The catalyst stripper removes absorbed hydrocarbon from the surface of the catalyst. The regenerator removes the coke from the catalyst and recycles the regenerated catalyst into the riser.

The spent catalyst particles are regenerated before catalytically cracking more hydrocarbons. Regeneration occurs by oxidation of the carbonaceous deposits to carbon oxides and water. The spent catalyst is introduced into a fluidized bed at the base of the regenerator, and oxygen-containing combustion air is passed upwardly through the bed. After regeneration, the regenerated catalyst is returned to the riser.

Oxides of nitrogen ($NO_x$) are usually present in regenerator flue gases but should be minimized because of environmental concerns. Regulated $NO_x$ emissions generally include nitric oxide (NO) and nitrogen dioxide ($NO_2$), but the FCC process can also produce $N_2O$. In an FCC regenerator, $NO_x$ is produced almost entirely by oxidation of nitrogen compounds originating in the FCC feedstock and accumulating in the coked catalyst. At FCC regenerator operating conditions, there is negligible $NO_x$ production associated with oxidation of $N_2$ from the combustion air. Production of $NO_x$ is undesirable because it reacts with volatile organic chemicals and sunlight to form ozone.

The two most common types of FCC regenerators in use today are a combustor-style regenerator and a bubbling bed regenerator. Bubbling bed and combustor-style regenerators may utilize a CO combustion promoter comprising platinum for accelerating the combustion of coke and CO to $CO_2$. The CO promoter decreases CO emissions but increases $NO_x$ emissions in the regenerator flue gas.

The combustor-style regenerator has a lower vessel called a combustor that burns nearly all the coke to $CO_2$ with little or no CO promoter and with low excess oxygen. The combustor is a highly backmixed fast fluidized bed. A portion of the hot regenerated catalyst from the upper regenerator is recirculated to the lower combustor to heat the incoming spent catalyst and to control the combustor density and temperature for optimum coke combustion rate. As the catalyst and flue gas mixture enters the upper, narrower section of the combustor, the velocity is further increased and the two-phase mixture exits through symmetrical downturned disengager arms into an upper regenerator. The upper regenerator separates the catalyst from the flue gas with the disengager arms followed by cyclones and return it to the catalyst bed which supplies hot regenerated catalyst to both the riser reactor and lower combustor.

A bubbling bed regenerator carries out the coke combustion in a dense fluidized bed of catalyst. Fluidizing combustion gas forms bubbles that ascend through a discernible top surface of a dense catalyst bed. Only catalyst entrained in the gas exits the reactor with the vapor. Cyclones above the dense bed separate the catalyst entrained in the gas and return it to the catalyst bed. The superficial velocity of the fluidizing combustion air is typically less than 1.2 m/s (4 ft/s) and the density of the dense bed is typically greater than 480 kg/m$^3$ (30 lb/ft$^3$) depending on the characteristics of the catalyst. The mixture of catalyst and vapor is heterogeneous with pervasive vapor bypassing of catalyst. The temperature will increase in a typical bubbling bed regenerator by about 17° C. (about 30° F.) or more from the dense bed to the cyclone outlet due to combustion of CO in the dilute phase. The flue gas leaving the bed may have about 2 mol-% CO. This CO may require about 1 mol-% oxygen for combustion. Assuming the flue gas has 2 mol-% excess oxygen, there will likely be 3 mol-% oxygen at the surface of the bed and higher amounts below the surface. Excess oxygen is not desirable for low $NO_x$ operation.

Refiners often use CO promoter (equivalent to 0.5 to 3 ppm Pt inventory) to control afterburn at the low excess $O_2$ required to control $NO_x$ at low levels. While low excess $O_2$ reduces $NO_x$, the simultaneous use of Pt CO promoter often needed for afterburn control can more than offset the advantage of low excess $O_2$.

Bubbling bed regenerators have a fluidized bed. Fluidized beds generally mix well vertically, up and down, but not laterally, or horizontally. Rising bubbles draw catalyst up with tem in their wakes and the catalyst constitutes about one third of total bubble volume. This is the principle solids mixing mechanism in fluidized beds. In a bubbling bed, also known as a dense catalyst bed, combustion gas forms bubbles that ascend through a discernible top surface of a dense catalyst bed. Relatively little catalyst is entrained in the combustion gas exiting the dense bed. These bubbles rise with little horizontal displacement.

The superficial velocity of the combustion gas is typically less than 1.2 m/s (4.2 ft/s) and the density of the dense bed is typically greater than 640 kg/m$^3$ (40 lb/ft$^3$) depending on the characteristics of the catalyst. The mixture of catalyst and combustion gas is heterogeneous with pervasive gas bypassing of catalyst.

The dilute transport flow regime is typically used in FCC riser reactors. In transport flow, the difference in the velocity of the gas and the catalyst is relatively low with little catalyst back mixing or hold up. The catalyst in the reaction zone maintains flow at a low density and very dilute phase conditions. The superficial gas velocity in transport flow is typically greater than 2.1 m/s (7.0 ft/s), and the density of the catalyst is typically no more than 48 kg/m$^3$ (3 lb/ft$^3$). The density in a transport zone in a regenerator may approach 80 kg/m$^3$ (5 lb/ft$^3$). In transport mode, the catalyst-combustion gas mixture is homogeneous without gas voids or bubbles forming in the catalyst phase.

Intermediate of dense, bubbling beds and dilute transport flow regimes are turbulent beds and fast fluidized regimes. In a turbulent bed, the mixture of catalyst and combustion gas is not homogeneous. The turbulent bed is a dense catalyst bed with elongated voids of combustion gas forming within the catalyst phase and a less discernible surface. Entrained catalyst leaves the bed with the combustion gas, and the catalyst density is not quite proportional to its elevation within the reactor. The superficial combustion gas velocity is between about 1.1 and about 2.1 m/s (3.5 and 7 ft/s), and the density is typically between about 320 and about 640 kg/m$^3$ (20 and 40 lb/ft$^3$) in a turbulent bed.

Fast fluidization defines a condition of fluidized solid particles lying between the turbulent bed of particles and complete particle transport mode. A fast fluidized condition is characterized by a fluidizing gas velocity higher than that of a dense phase turbulent bed, resulting in a lower catalyst density and vigorous solid/gas contacting. In a fast fluidized zone, there is a net transport of catalyst caused by the upward flow of fluidizing gas. The catalyst density in the fast fluidized condition is much more sensitive to particle loading than in the complete particle transport mode. From the fast fluidized mode, further increases in fluidized gas velocity will raise the rate of upward particle transport, and will sharply reduce the average catalyst density until, at sufficient gas velocity, the particles are moving principally in the complete catalyst transport mode. Thus, there is a continuum in the progression from a fluidized particle bed through fast fluidization and to the pure transport mode. The superficial combustion gas velocity for a fast fluidized flow regime is typically between about 1.5 and about 3.1 m/s (5 and 10 ft/s) and the density is typically between about 48 and about 320 kg/m$^3$ (3 and 20 lb/ft$^3$).

A combustor-style regenerator is a type of regenerator that completely regenerates catalyst in a lower, first combustion chamber under fast fluidized flow conditions with a relatively small amount of excess oxygen. A riser carries regenerated catalyst and spent combustion gas to a separation chamber wherein significant combustion occurs. Regenerated catalyst in the separation chamber is recycled to the lower combustion phase to heat the spent catalyst about to undergo combustion. The regenerated catalyst recycling provides heat to accelerate the combustion of the lower phase of catalyst. Combustor-style regenerators are advantageous because of their efficient oxygen requirements.

As greater demands are placed on FCC units, combustor vessels are being required to handle greater catalyst throughput. Greater quantities of combustion gas are added to the combustor vessels to combust greater quantities of catalyst. As combustion gas flow rates are increased, so does the flow rate of catalyst between the combustion and separation chamber increase. Hence, unless the combustion chamber of a combustor vessel is enlarged, the residence time of catalyst in the lower zone will diminish, thereby decreasing the thoroughness of the combustion that must be achieved before the catalyst enters the separation chamber.

An enlarged first chamber diameter increases the diameter of the fluidized bed and therefore the distance between the spent catalyst, at a cooler temperature, input and recycled catalyst, at a hotter temperature, is increased. Areas of temperature difference and generally stagnant zones of the high oxygen concentrations and may result and combustion efficiency may decrease. In the first chamber vertical mixing may occur, but there is usually little horizontal, or lateral, mixing. There exists a need for better lateral mixing in fluidized beds.

SUMMARY OF THE INVENTION

Apparatus and process for increasing mixing in a fluidized bed. A slide, which may be in the form of a tube or trough, transports particles from an upper zone downward to a lower zone at a different horizontal position, thereby changing the horizontal position of the particle and creating lateral mixing in the fluidized bed. Increased mixing may improve efficiency for an apparatus using a fluidized bed.

For example, in a regenerator areas of temperature and oxygen level differences, as well as general stagnation may occur. Recycle and recirculation standpipe inlet and outlet positions in may further exasperate these differences in temperature and oxygen concentration. Increasing lateral mixing in a regenerator may increase temperature and oxygen mixing and reduce stagnation to improve efficiency. A slide may be relatively unobtrusive, inexpensive, and simple for a retrofit or design modification and may improve combustion efficiency at high rates by enhancing the lateral blending of spent and regenerated catalyst.

DETAILED DESCRIPTION

Figure 1:
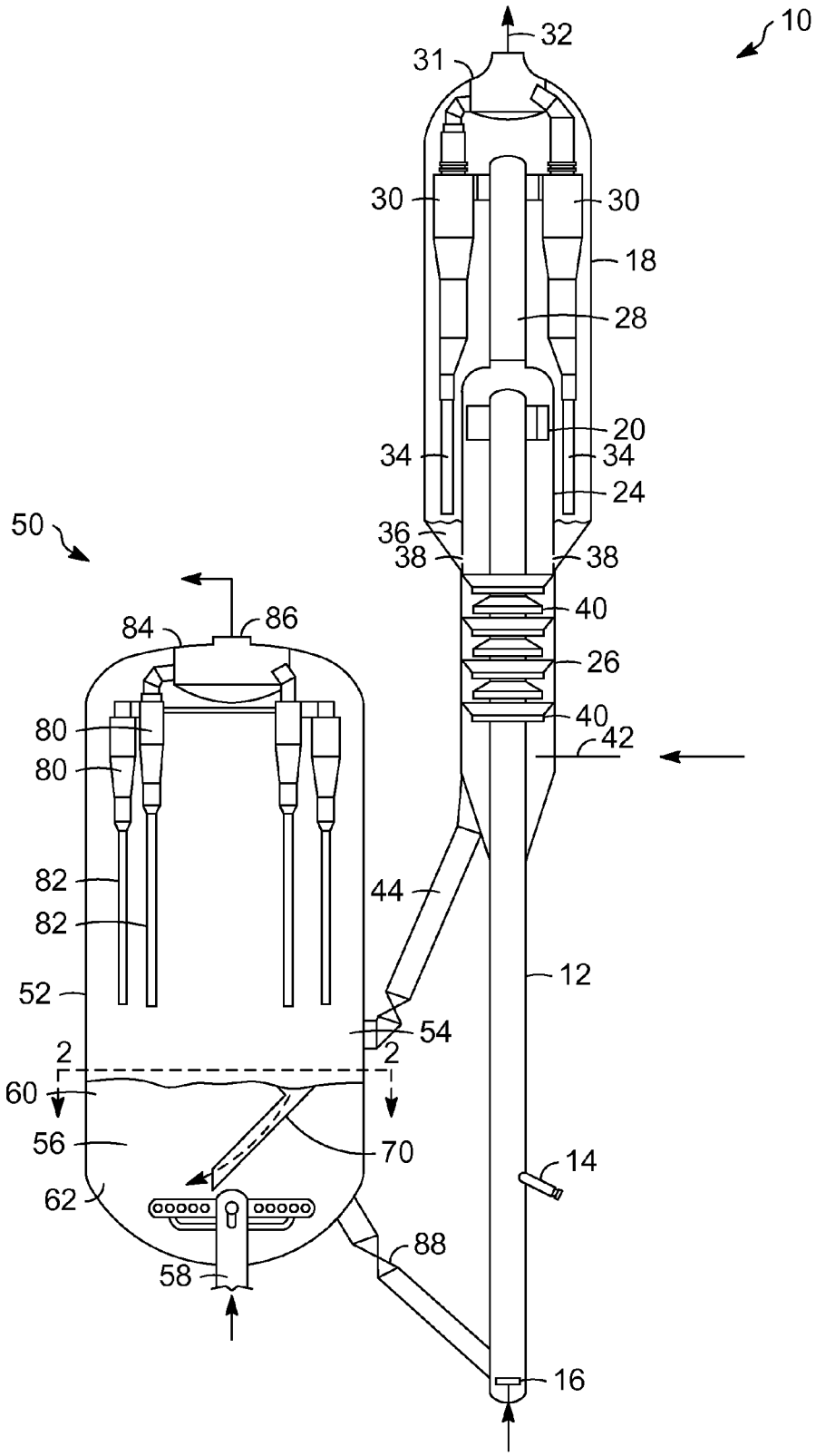
FIG. 1 is an elevational diagram showing an FCC unit with a bubbling bed style regenerator with a slide.

The FCC process may use an FCC unit 10, as shown in FIG. 1. Feedstock enters a riser 12 through a feed distributor 14. Feedstock may be mixed with steam in the feed distributor 14 before entering. Lift gases, which may include inert gases or steam, enters through a steam sparger 16 in the lower portion of the riser 12 and creates a fluidized medium with the catalyst. Feedstock contacts the catalyst to produce cracked hydrocarbon products and spent catalyst. The hydrocarbon products are separated from the spent catalyst in the reactor 18.

The blended catalyst and reacted feed vapors enter the reactor 18 and are separated into a cracked product vapor stream and a collection of catalyst particles covered with substantial quantities of coke and generally referred to as spent catalyst or coked catalyst. Various arrangements of separators to quickly separate coked catalyst from the product stream may be utilized. In particular, a swirl arm arrangement 20, provided at the end of the riser 12, may further enhance initial catalyst and cracked hydrocarbon separation by imparting a tangential velocity to the exiting catalyst and cracked product vapor stream mixture. The swirl arm arrangement 20 is located in an upper portion of a separation chamber 24, and a stripping zone 26 is situated in the lower portion. Catalyst separated by the swirl arm arrangement 20 drops down into the stripping zone 26.

The cracked product comprising cracked hydrocarbons including gasoline and light olefins and some catalyst may exit the separation chamber 24 via a gas conduit 28 in communication with cyclones 30. The cyclones 30 may remove remaining catalyst particles from the product vapor stream to reduce particle concentrations to very low levels. The product vapor stream may enter into a reactor plenum 31 and exit the reactor 18 through a product outlet 32. Catalyst separated by the cyclones 30 may return to the reactor 18 through reactor diplegs 34 into a dense bed 36 where catalyst passes through chamber openings 38 and enter the stripping zone 26. The stripping zone 26 removes entrained hydrocarbons between catalyst particles and adsorbed hydrocarbons from the surface of the catalyst by counter-current contact with steam over optional baffles 40. Steam may enter the stripping zone 26 through a line 42. A spent catalyst conduit 44 transfers spent catalyst to a regenerator 50.

The regenerator 50 receives the spent catalyst into a vessel 52, shown as a bubbling bed regenerator vessel in FIGS. 1-4, or a combustor, or first chamber, in a combustor-style regenerator shown in FIGS. 5-8, through an inlet 54. Spent catalyst may enter into a fluidized bed 56 in the vessel 52. The fluidized bed 56 may have a mixing apparatus.

A mixing apparatus for a fluidized bed 56 may have multiple embodiments. The mixing apparatus may be a slide 70. The slide 70 may have a first end 71 in the upper zone 60 and a second end 72 at a different horizontal position in the lower zone 62.

In a bubbling bed regenerator, rising bubbles move catalyst from the lower zone 62 to the upper zone 60. The first end 71 may receive particles and transport the particles down the slide 70 to be dispensed from the second end 72 into a different horizontal position in the lower zone 62. Bubbles then may transport catalyst from the new position on in the lower zone 62 to a new position in the upper zone 60. An emulsion phase flows counter to the draft that is created by the flow into and out of the slide 70 to maintain the overall bed level.

In a combustor-style regenerator 50 catalyst mixes well vertically and particles traveling downward from the upper zone 62 may be received by first end 71 and transported laterally to dispense from second end 72. Fluidizing medium may then force the particle into the upper zone 60 at this new horizontal position. Lateral mixing occurs as a result of the change in horizontal position.

Figure 2:
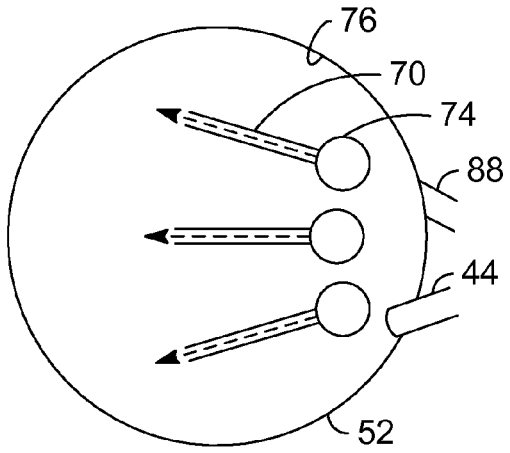
FIG. 2 is a cross section view from line 2-2 of FIG. 1.

The slide 70 may be a tube, a trough, or a channel. The slide 70 may be made of angle iron or channel iron. As shown in FIGS. 1 and 2, an accumulator 74 may attach to the first end 71 of the slide 70 to funnel particles into the first end 71. The slide 70 may be attached to the wall 76 for stability. A tube is preferred because a tube can generate head, or pressure, due to density differences between the fluidized bed 56 and the fluidized materials in the tubes and will drive greater flow rates. Slide 70 may be perforated. The opening at the bottom of a slide 70 may have a vertical edge to decrease upward moving gases and particles from entering. A one-way valve on the bottom opening may be used to decrease the entrance of upward moving particles and gases. Dashed lines with arrowheads in the vessel 52 of the FIGURES represent particles entering the first end 71 of the slide 70 and exiting from the second end 72 at a different horizontal location with the arrowhead indicating the direction of movement.

Figure 3:
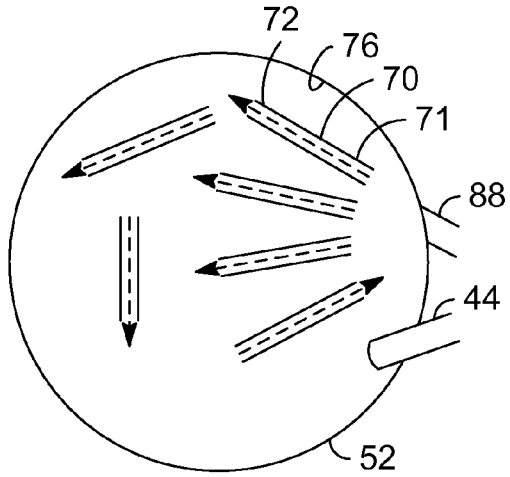
FIG. 3 is a cross section view of a regenerator with a plurality of slides.
Figure 4:
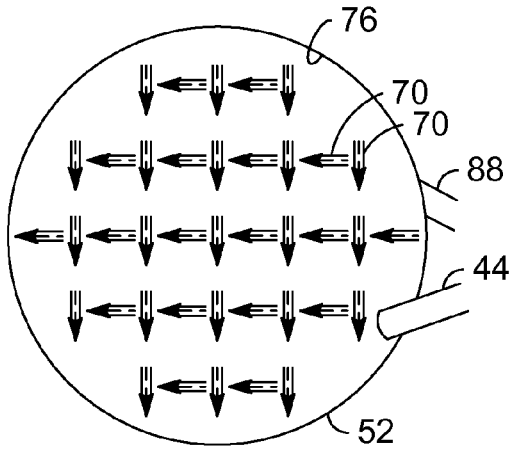
FIG. 4 is a cross section view of a regenerator with an arrangement of slides.
Figure 5:
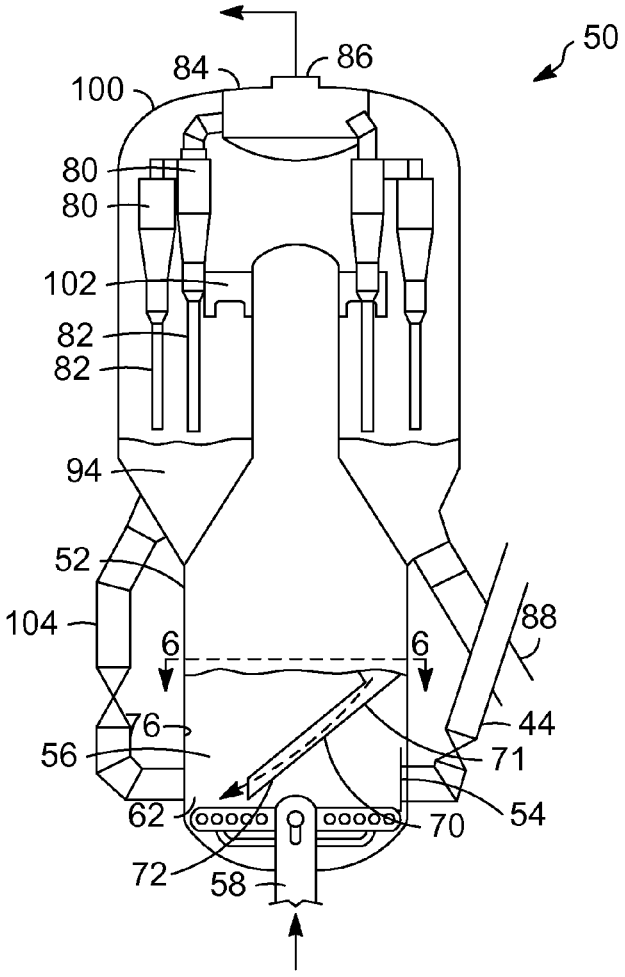
FIG. 5 is an elevational diagram showing a combustor-style regenerator with a slide.

Multiple slides 70 may be positioned in the bed at strategic locations at an angle equal to or greater than the angle of repose of the solid being fluidized. As shown in FIGS. 3-4, slides 70 may be arranged in patterns to generate additional mixing in the fluidized bed 56. The number of slides 70 and the diameter of each slide 70 may depend on the size of the fluidized bed 56 and the amount of mixing to be generated. Length of the slide 70 may be a function of the bed 56 height. A larger and longer slide 70 may be used to generate flow from one general area to another and counter flow or natural circulation to reestablish the level. Thus, the number and dimensions of slide 70 may be adjusted for optimal mixing for the particular fluidized bed 56 diameter, height, inlet-outlet configuration, and rates.

Figure 7:
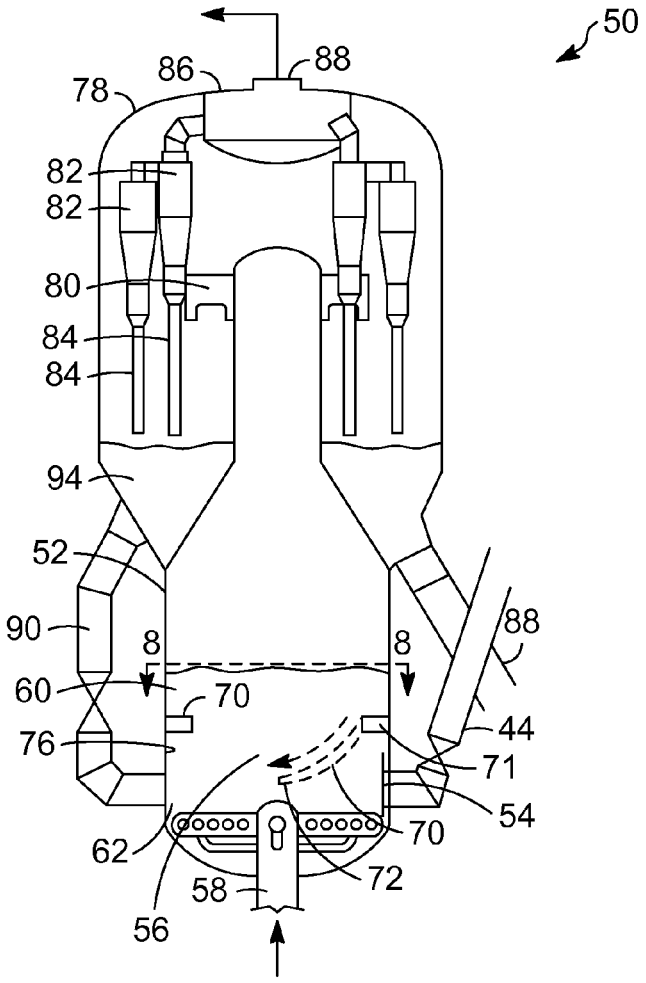
FIG. 7 is an elevational diagram showing a combustor-style regenerator with an alternative embodiment of a slide.
Figure 8:
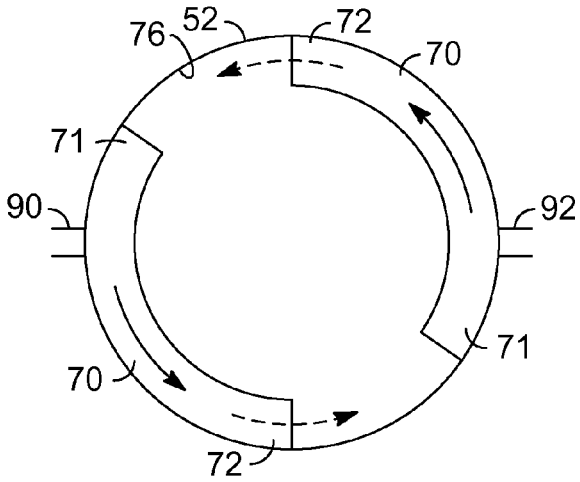
FIG. 8 is a cross section view from line 8-8 of FIG. 7.

In one embodiment, as shown in FIGS. 7-8, slide 70 may be attached to the inside of the vessel 52 with the elevated first end 71 and transfer particles near and along the wall 76 to the second end 72 at a different horizontal position. The slope of the slide 70 relative to horizon may be between about 10° and 60°, preferably between about 12° and about 25°. The width of the slide 70 may vary to accommodate different sized vessels 52 and to take into consideration affects on the upward movement of particles in the vessel 52. Preferably, the width of the slide 70 is equal to between about 1% and about 15% of the diameter of the vessel 52, even more preferably between about 2% and about 10%.

Combustion of coke from the spent catalyst particles raises the temperatures of the catalyst. Flue gas consisting primarily of $N_2$, $H_2O$, $O_2$, $CO_2$ and traces of $NO_x$, CO, and $SO_x$ passes upwardly from the dense bed into a dilute phase of the regenerator 50. Typically above the fluidized bed in a bubbling bed regenerator 50, or in an upper chamber 100 of a combustor-style regenerator 50 may be a regenerator cyclone 80 or other means to remove entrained catalyst particles from the rising flue gas, usually having a regenerator dipleg 82 for releasing catalyst. Gases may enter a plenum 84 before exiting through a vent 86. Depending on the size and throughput of a regenerator 50, between about 6 and 60 regenerator diplegs 82 may be utilized. In a combustor-style regenerator catalyst from regenerator dipleg 82 may enter a regenerator dense bed 94. From this regenerator dense bed 94 in a combustor-style regenerator, or from the vessel 52 in a bubbling bed regenerator, catalyst may pass, regulated by a control valve, through a regenerator standpipe 88, which attaches to the bottom portion of riser 12.

Figure 6:
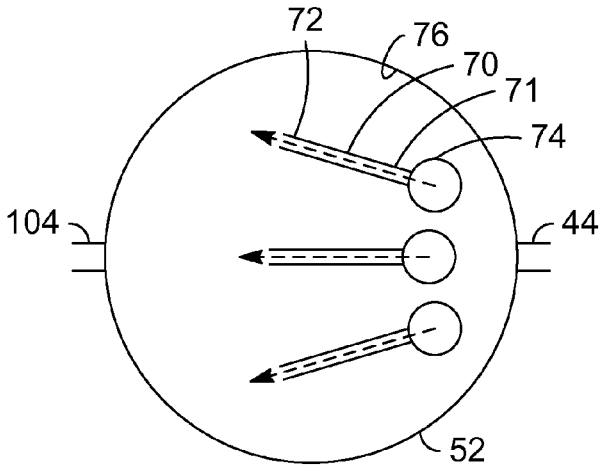
FIG. 6 is a cross section view from line 6-6 of FIG. 5.

As shown in FIG. 5-8, the upper chamber 100 may receive flue gas and catalyst from the vessel 52 through a disengager 102. Regenerated catalyst may be recycled into the vessel 52 through a recycle standpipe 104. FIG. 6 shows a cross section of the vessel 52 indicating the positions of the spent catalyst conduit 44 and recycle standpipe 104 on opposite sides of the vessel 52. Bubbling bed regenerators may also have a recycle standpipe 104 and recycle regenerated catalyst to the lower zone 62 of the vessel 52.

The hottest and most completely regenerated catalyst is recirculated to the lower zone of the vessel 52, in a bubbling bed regenerator, or the lower chamber in a combustor-style regenerator, making the hot spot hotter, while the least completely regenerated catalyst is returned to the riser 12. Preferably, it would be better to reverse this, returning the most completely regenerated catalyst to the riser 12 and recirculating the less regenerated material to the first chamber 52 for another pass. This may permit more stable operations at lower regenerator temperatures.

Analysis of temperature data from a large diameter vessel 52 of a combustor-style regenerator with extensive thermometry indicated the presence of relative hot spots where cooler fresh and hotter regenerated catalyst standpipes enter the vessel 52. In this combustor-style regenerator the data shows a relatively cool spot of about 640° C. to about 670° C. very near the entry of spent catalyst. The temperature of the cool spot is just above the mid point between the about 740° C. regenerated catalyst temperature and the 530-540° C. spent catalyst. With perfect mixing it could roughly be two thirds of the regenerated catalyst temperature. A hot spot, of about 25-40° C. hotter, exists at the bottom of the vessel 52 at the return of the regenerated catalyst recirculation standpipe 104. The temperature profiles at higher elevations show that the hot and cool areas propagate vertically through the vessel 52 up to bottom of the upper chamber 100. As the flue gasses and catalyst rise, the exotherm of combustion and lateral mixing and dispersion reduce the magnitude of the differences hot and cool spot temperatures 5-10° C.

Mixing in a regenerator 50 promotes more uniform temperatures and catalyst activity through improved fuel distribution to promote a more efficient reaction between the gases and catalyst. The improved mixing Refiners often use high levels of Pt CO combustion promoter and high levels of excess $O_2$ to accelerate combustion and reduce afterburning in their FCC unit, especially when operating at high throughputs. These practices may increase $NO_x$ by up to 10-fold from the 10-30 ppm possible when no platinum is used and excess $O_2$ is controlled below 0.5 v-%.

A process for increasing mixing, especially lateral mixing, in a fluidized bed 56 may include one or more of the described apparatus. Increasing lateral mixing in the bed 56 may be accomplished by including a slide 70. Such a process may include introducing catalyst to a vessel 52 through an inlet 54. Gas is distributed to the vessel 52 below said inlet. Particles of a fluidized bed 56 may be directed from an upper zone 60 of the vessel 52 to a different horizontal position in a lower zone 62 of the vessel to increase the lateral mixing of the bed 56. This process may occur in a combustor-style or a bubbling bed regenerator 50.

The examples and figures provided are mostly in reference to embodiments used in FCC and RFCC regenerators; however, the invention should not be limited to only regenerators or to the these processes.

The invention claimed is:

1. A process for increasing lateral mixing in a fluidized bed, comprising:

introducing catalyst into a vessel through an inlet;

distributing gas in said vessel below said inlet;

directing said catalyst from an upper zone of said fluidized bed of said vessel to a different horizontal position in a lower zone of said vessel over a slide;

increasing lateral mixing of the fluidized bed;

lifting said catalyst entrained in said gas; and separating said catalyst from said gas.

2. The process as in claim 1, wherein said directing step is accomplished using a slide having a first end positioned in an upper zone of said fluidized bed and a second end spaced horizontally.

3. The process as in claim 2, wherein said process decreases the temperature difference between areas in said vessel.

4. The process as in claim 2, further comprising oxidation of carbonaceous deposits on the catalyst wherein said gas comprises a decreased level of excess $O_2$ to promote lower $NO_x$ and CO emissions as compared to oxidation processes without increased lateral mixing.

* * * * *